US009079113B2

(12) United States Patent
Wong et al.

(10) Patent No.: US 9,079,113 B2
(45) Date of Patent: Jul. 14, 2015

(54) INTERACTIVE PERSONAL ROBOTIC APPARATUS

(71) Applicants: Tit Shing Wong, Kowloon (CN); Wai Choi Lewie Leung, Kowloon (CN); Kwok Yau Cheung, New Territories (CN)

(72) Inventors: Tit Shing Wong, Kowloon (CN); Wai Choi Lewie Leung, Kowloon (CN); Kwok Yau Cheung, New Territories (CN)

(73) Assignee: J. T. Labs Limited, Fanling, New Territories (CH)

( * ) Notice: Subject to any disclaimer, the term of this patent is extended or adjusted under 35 U.S.C. 154(b) by 257 days.

(21) Appl. No.: 13/735,712

(22) Filed: Jan. 7, 2013

(65) Prior Publication Data

US 2013/0178982 A1 Jul. 11, 2013

Related U.S. Application Data

(60) Provisional application No. 61/583,999, filed on Jan. 6, 2012.

(51) Int. Cl.

| | |
|---|---|
| ***G05B 15/00*** | (2006.01) |
| ***A63H 13/00*** | (2006.01) |
| ***A63H 3/00*** | (2006.01) |
| ***A63H 3/28*** | (2006.01) |
| ***A63H 3/40*** | (2006.01) |

(52) U.S. Cl.

CPC ..... *A63H 13/00* (2013.01); *A63H 3/001* (2013.01); *A63H 3/28* (2013.01); *A63H 3/40* (2013.01); *A63H 2200/00* (2013.01)

(58) Field of Classification Search

CPC combination set(s) only.
See application file for complete search history.

(56) References Cited

U.S. PATENT DOCUMENTS

| | | | | |
|---|---|---|---|---|
| 4,718,876 | A * | 1/1988 | Lee | 446/295 |
| 6,554,679 | B1 * | 4/2003 | Shackelford et al. | 446/268 |
| 6,708,068 | B1 * | 3/2004 | Sakaue | 700/47 |
| 6,959,166 | B1 * | 10/2005 | Gabai et al. | 434/308 |
| 7,731,559 | B1 * | 6/2010 | Maddocks | 446/297 |
| 2002/0094746 | A1 * | 7/2002 | Harlev | 446/178 |
| 2002/0130673 | A1 * | 9/2002 | Pelrine et al. | 324/727 |
| 2003/0066050 | A1 * | 4/2003 | Wang et al. | 717/105 |
| 2003/0220796 | A1 * | 11/2003 | Aoyama et al. | 704/275 |
| 2004/0161732 | A1 * | 8/2004 | Stump et al. | 434/262 |
| 2004/0249510 | A1 * | 12/2004 | Hanson | 700/245 |
| 2006/0003664 | A1 * | 1/2006 | Yeh | 446/175 |
| 2006/0056678 | A1 * | 3/2006 | Tanaka et al. | 382/153 |
| 2006/0270312 | A1 * | 11/2006 | Maddocks et al. | 446/337 |
| 2007/0010913 | A1 * | 1/2007 | Miyamoto et al. | 700/264 |
| 2007/0037474 | A1 * | 2/2007 | Lee | 446/297 |
| 2007/0128979 | A1 * | 6/2007 | Shackelford et al. | 446/484 |
| 2007/0142965 | A1 * | 6/2007 | Lin | 700/245 |
| 2007/0149091 | A1 * | 6/2007 | Viohl | 446/484 |
| 2008/0119959 | A1 * | 5/2008 | Park et al. | 700/245 |
| 2009/0055019 | A1 * | 2/2009 | Stiehl et al. | 700/249 |
| 2011/0028219 | A1 * | 2/2011 | Heatherly et al. | 463/42 |
| 2012/0022688 | A1 * | 1/2012 | Wong et al. | 700/253 |
| 2014/0038489 | A1 * | 2/2014 | Sharma et al. | 446/175 |

* cited by examiner

*Primary Examiner* — Jonathan L Sample
(74) *Attorney, Agent, or Firm* — Erickson Kernell Derusseau & Kleypas, LLC

(57) ABSTRACT

An interactive robotic apparatus that interacts with a user, especially an elderly individual to provide companionship and comfort. The interactive apparatus receives inputs from the user and reacts and interacts. The interactive robotic apparatus includes microphones and a phototransistor to detect sounds and movement. The interactive robotic apparatus also includes a speaker to generate sounds responsive to the interaction with the user and exhibits a breathing animation and heartbeat.

4 Claims, 9 Drawing Sheets

INTERACTIVE PERSONAL ROBOTIC APPARATUS

CROSS REFERENCE TO RELATED APPLICATION

This application claims benefit of application Ser. No. 61/583,999, filed Jan. 6, 2012, entitled INTERACTIVE PERSONAL ROBOTIC APPARATUS.

The present invention relates to an interactive robotic apparatus and, more particularly, to a personal interactive robotic apparatus, which detects user interactions and performs responsive motion animations.

BACKGROUND

Various interactive robots are well known. Personal robots that display pre-determined movements are also known. Conventional personal robots typically move in predictable ways, and do not positively interact with the user or exhibit a personality. This limits their use and utility.

SUMMARY

The present invention provides an interactive robotic apparatus that interacts with a user, especially an elderly individual to provide companionship and comfort. The interactive apparatus receives inputs from the user and reacts and interacts. The interactive robotic apparatus includes microphones and a phototransistor to detect sounds and movement. The interactive robotic apparatus also includes a speaker to generate sounds responsive to the interaction with the user and exhibits a breathing animation and heartbeat.

DETAILED DESCRIPTION

Figure 1:
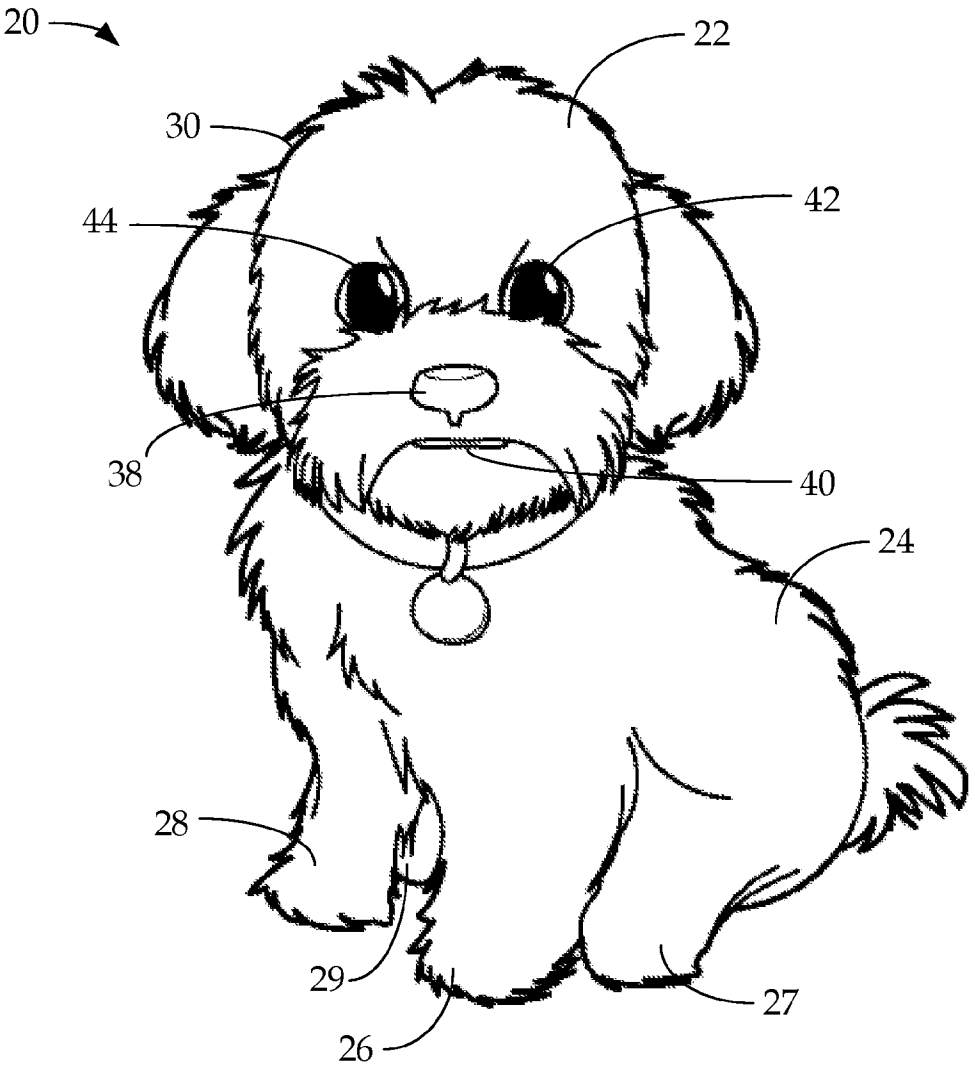
FIG. 1 is a perspective view of an embodiment of the interactive robotic apparatus of the present invention.
Figure 3:
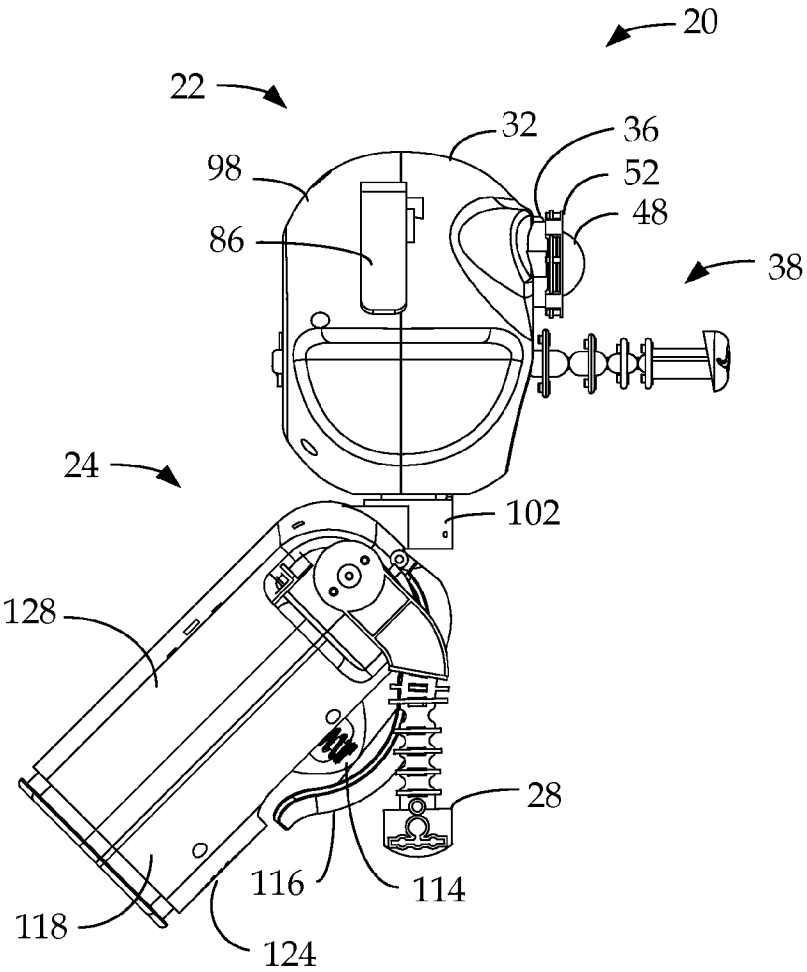
FIG. 3 is a right side view of the interactive robotic apparatus of FIG. 2.
Figure 2:
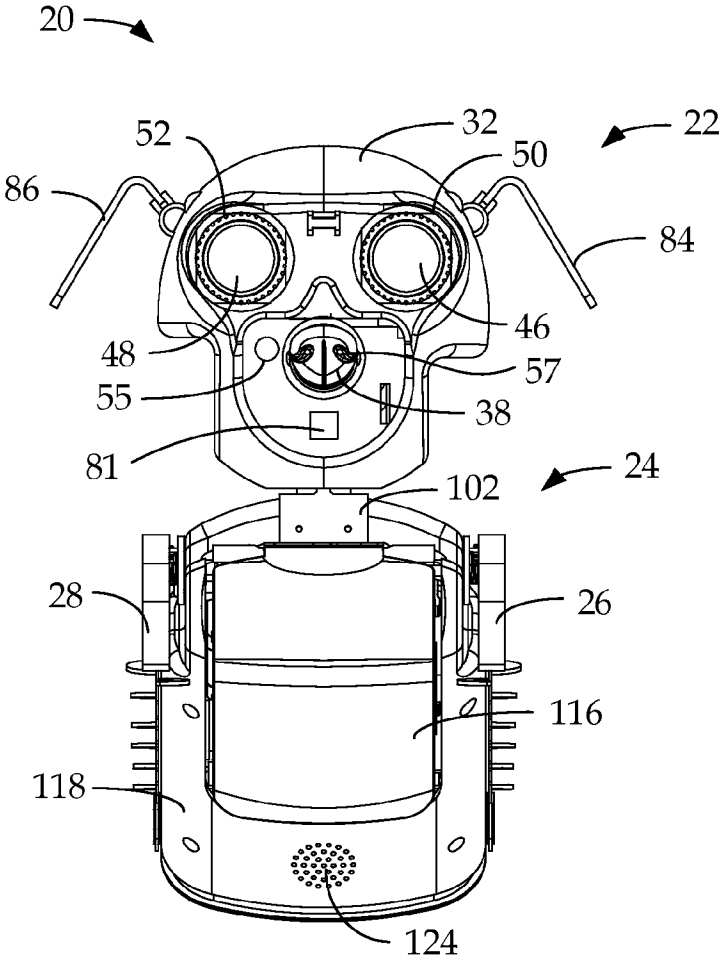
FIG. 2 is a front elevation view of the interactive robotic apparatus of the present invention with the outer skin removed.
Figure 5:
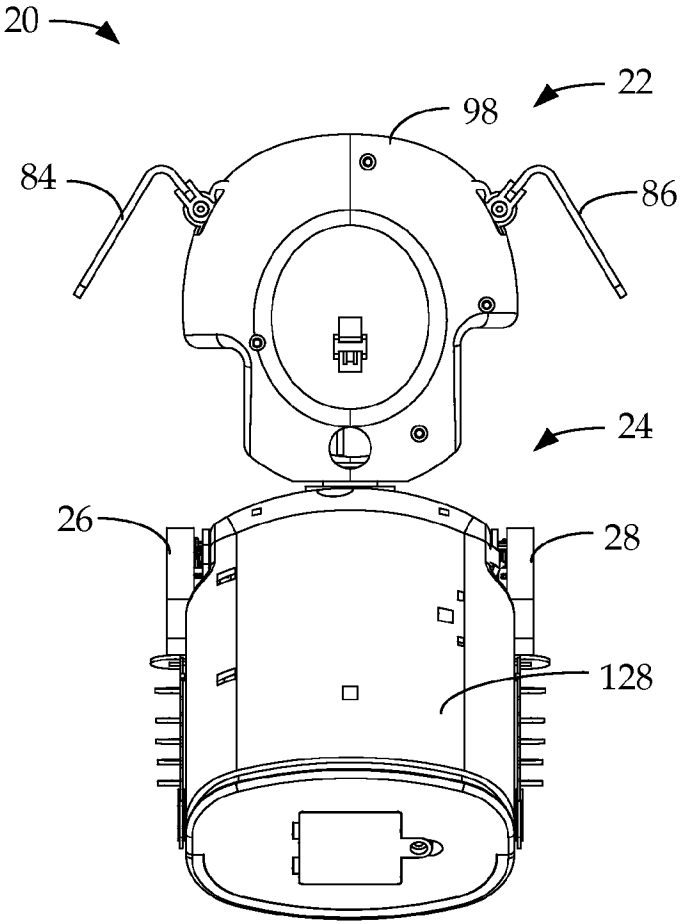
FIG. 5 is a back view of the interactive robotic apparatus of FIG. 2.
Figure 4:
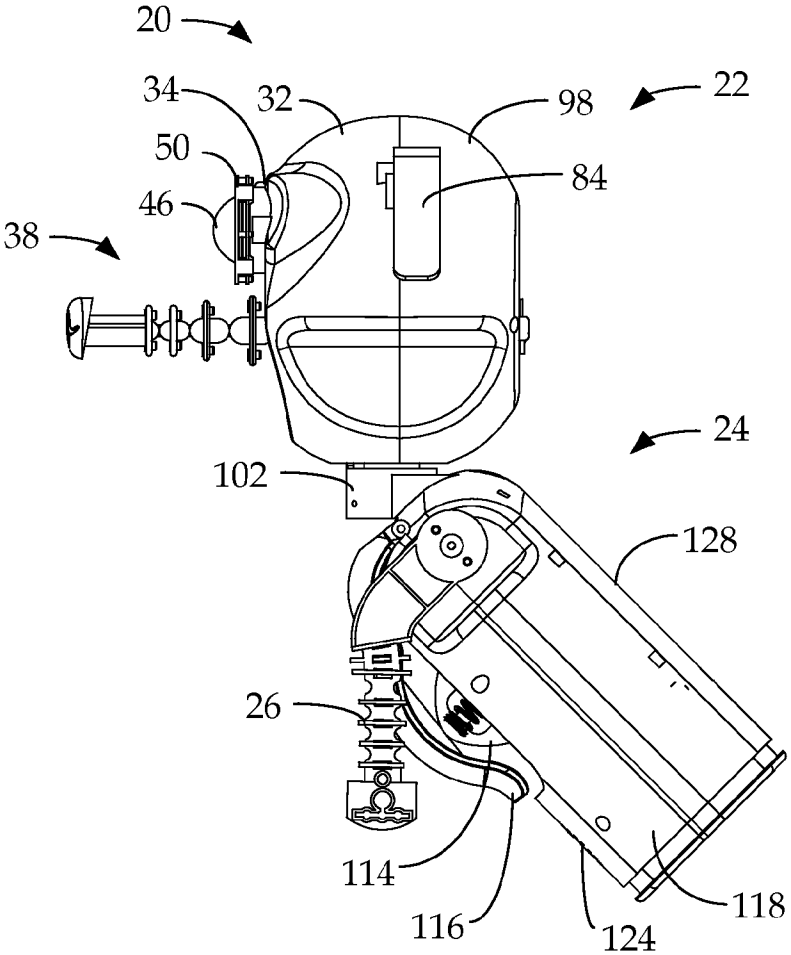
FIG. 4 is a left side view of the interactive robotic apparatus of FIG. 2.
Figure 7:
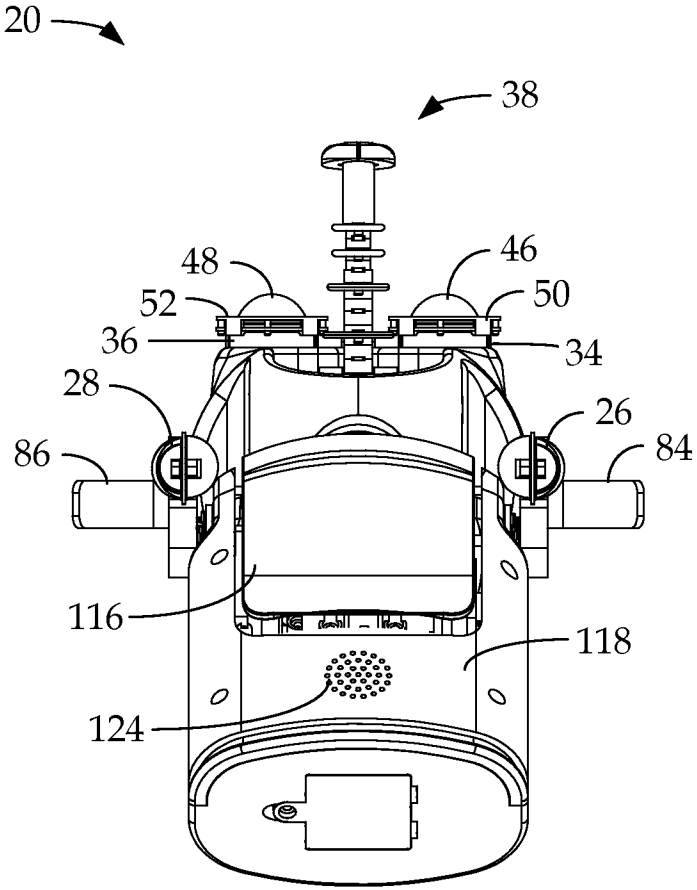
FIG. 7 is a bottom view of the interactive robotic apparatus of FIG. 2.
Figure 6:
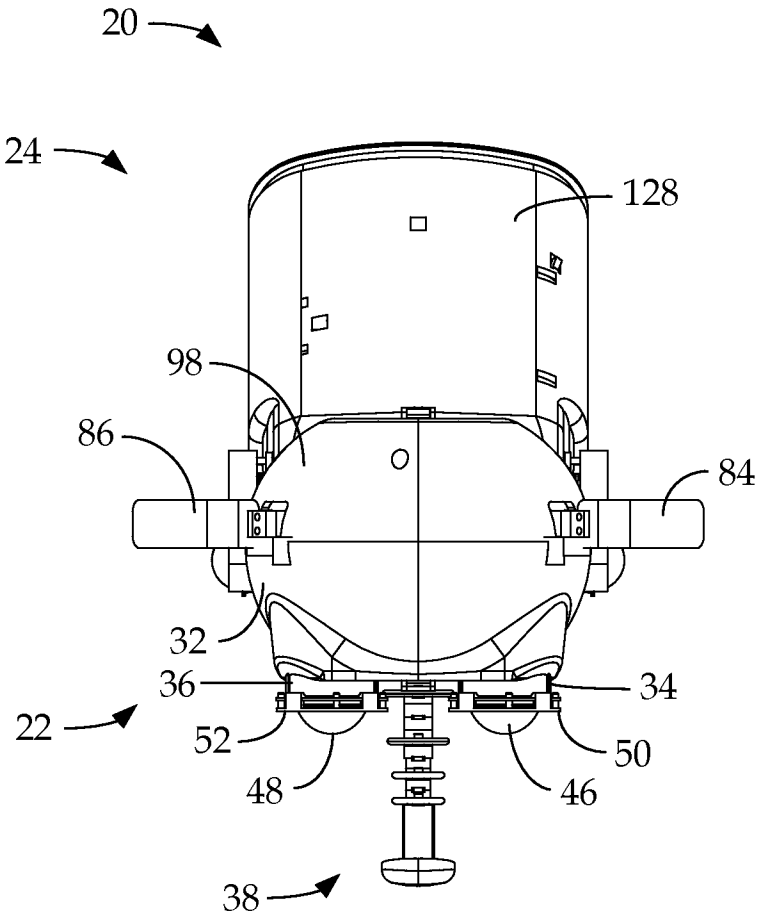
FIG. 6 is a top view of the interactive robotic apparatus of FIG. 2.
Figure 8:
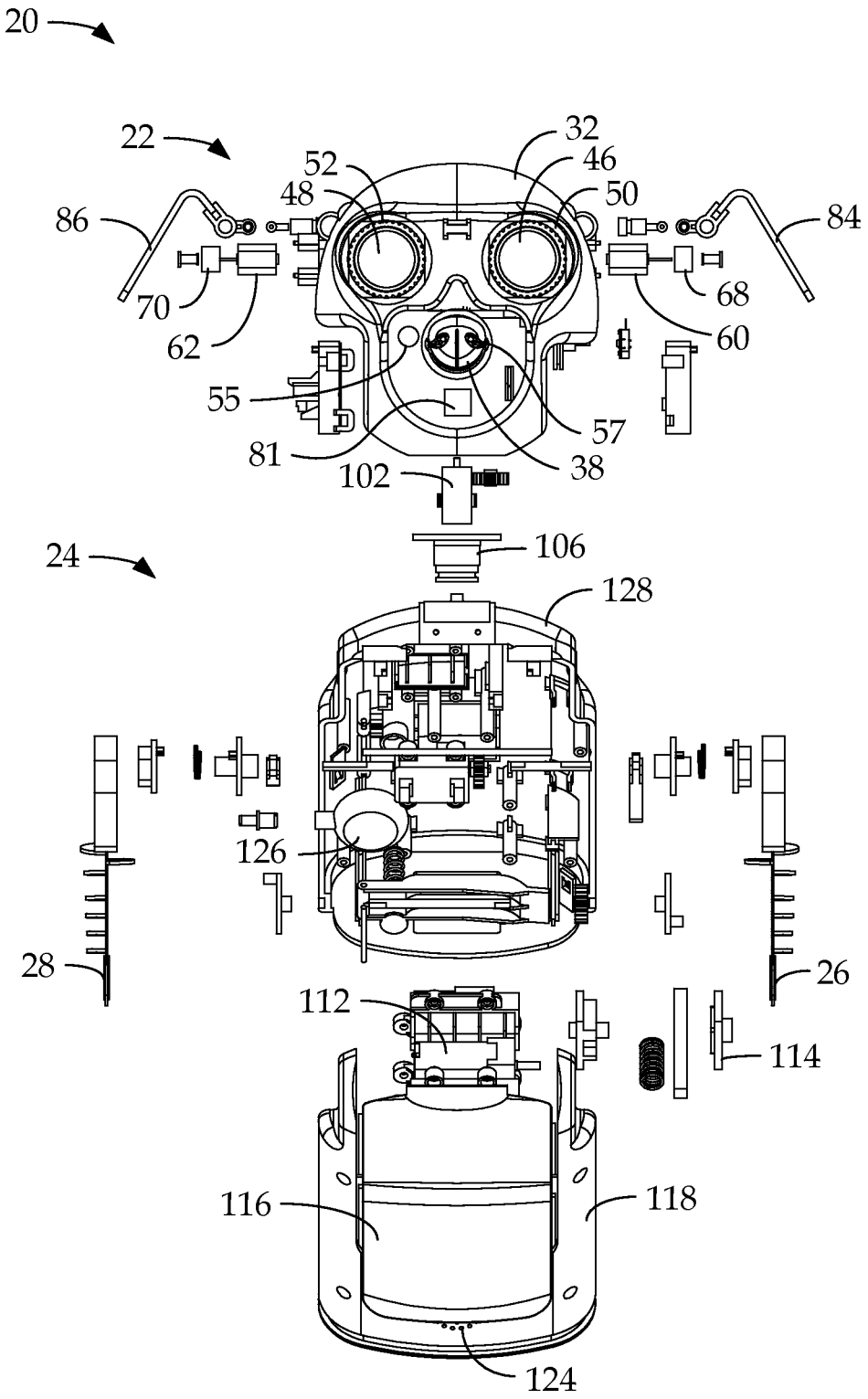
FIG. 8 is an exploded view of the interactive robotic apparatus of FIG. 2.
Figure 9:
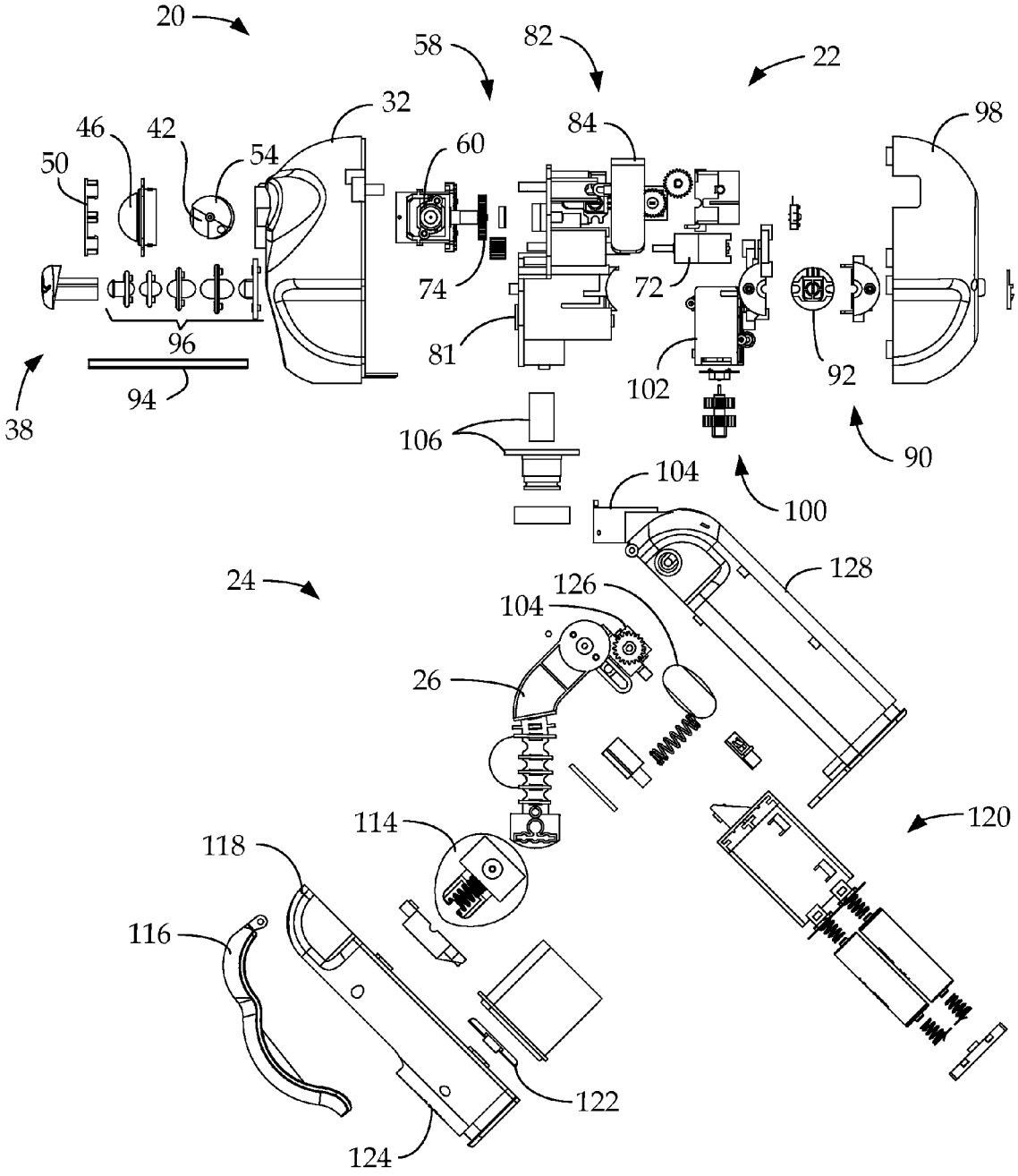
FIG. 9 is an exploded view of the interactive robotic apparatus of FIG. 4.
Figure 10A:
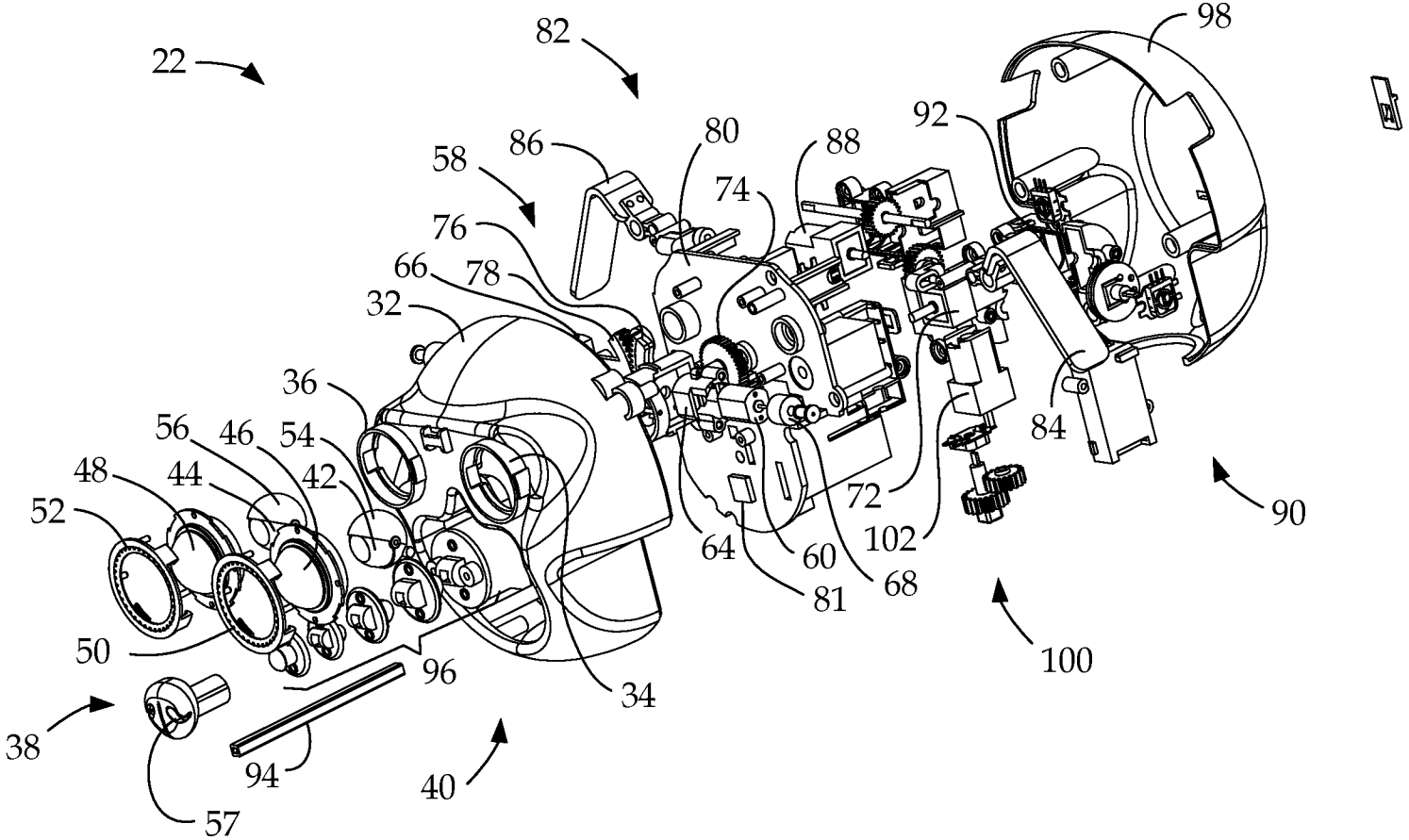
FIGS. 10A and B are exploded perspective views of the interactive robotic apparatus of FIG. 2.
Figure 10B:
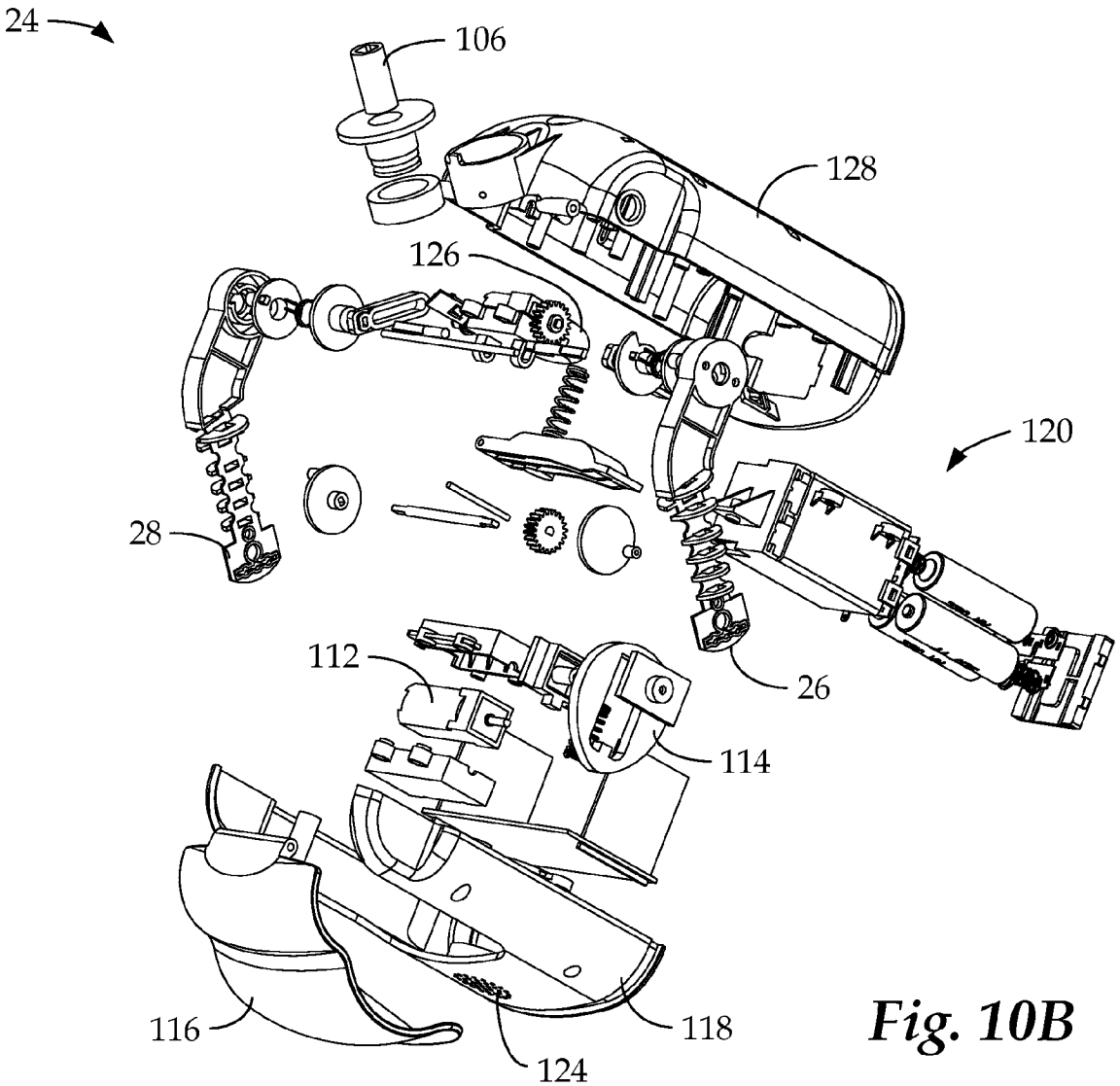

As required, detailed embodiments of the present invention are disclosed herein. However, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

Moreover, except where otherwise expressly indicated, all numerical quantities in this description and in the claims are to be understood as modified by the word "about" in describing the broader scope of this invention. Practice within the numerical limits stated is generally preferred. Also, unless expressly stated to the contrary, the description of a group or class of materials as suitable or preferred for a given purpose in connection with the invention implies that mixtures or combinations of any two or more members of the group or class may be equally suitable or preferred.

Referring to the figures, an interactive robotic apparatus of the present invention is generally indicated by reference numeral 20. The interactive robotic apparatus 20 generally includes a head assembly 22, a body assembly 24, left 26 and right 28 front legs, left 27 and right 29 back legs, and a plush covering 30 such as fur.

The head assembly 22 includes a face plate 32 with eye sockets 34 and 36, a nose 38 and mouth 40. The eye sockets 34 and 36 receive eyes 42 and 44, respectively, which are covered by lenses 46 and 48, respectively, and held in place with retaining rings 50 and 52, respectively. Each eye 42 and 44 includes eyelids 54 and 56, respectively. A microphone 55 is mounted to the face 32 to pick-up sounds and voice signals to interactively respond. A photo transistor 57 is also mounted to the nose 38 to detect movement.

An eye actuating mechanism 58 includes left 60 and right 62 eyelid actuators, each mounted to an eye carriage 64 and 66, respectively. Each eyelid actuator 60 and 62 includes a rubber cylinder 68 and 70, which impinges upon the back of the eyelids 54 and 56, to actuate the eyelids. As the eyelid actuators rotate in one direction or the other, the rubber cylinders 68 and 70 cause the eyelids 54 and 56 to rotate about an axis of rotation of the eyes 42 and 44.

The eye actuating mechanism 58 also includes an eye actuator 72, which drives an eye movement gear 74 coupled to the left eye carriage 64. The left eye carriage 64 is pivotably coupled to the right eye carriage 66 via arcuate gears 76 and 78, respectively. Rotation of the eye actuator 72 in a first direction then in the opposite direction causes the eyes 42 and 44 to move back and forth. The eye actuating mechanism 58 as well as the face 32 is fastened to a face plate 80.

An RFID sensor 81 is secured to the face plate 80 in the area near the mouth 40.

An ear actuating mechanism 82 is also fastened to the face plate 80 and includes left 84 and right 86 ears, and a servo actuator 88 coupled to the left 84 and right 86 ears to move the ears up and down or back and forth, for example.

A nose actuating mechanism 90 includes a nose servo actuator 92 coupled to a rod 94, which extends through articulated nose disks 96 and is capped by the nose 38. Activation of the nose servo actuator 92 moves the nose 38 up and down or side to side, for example. The back of the head plate 98 is coupled to the face plate 80 to enclose the components of the head assembly 22.

The body assembly 24 includes a neck actuating mechanism 100, which includes a head rotation servo actuator 102 to rotate the head assembly 22 to the left and right, and a head nod actuator 104 to move the head 22 up and down. The head assembly 22 is pivotally attached to the body assembly 24 at a neck 106.

The body assembly 24 includes a belly actuating mechanism 110, which includes a belly actuator 112 coupled to a lobed cam 114 rotated by the belly actuator 112. The lobed cam 114 impinges upon a breast plate 116, which is hingedly secured to a front body plate 118. As the lobed cam 114 is rotated by the belly actuator 112, the breast plate 116 moves in and out simulating a breathing motion. A battery pack 120 is mounted in the body 24 to power the actuators and control circuit 150, discussed herein below. A speaker 122 is mounted to the front body plate 118 behind a speaker grill 124. A heartbeat simulator 126 is mounted within the body assembly 24 to simulate a heartbeat. The front body plate 118 is fastened to a back body plate 128 enclosing the body 24.

Figure 11:
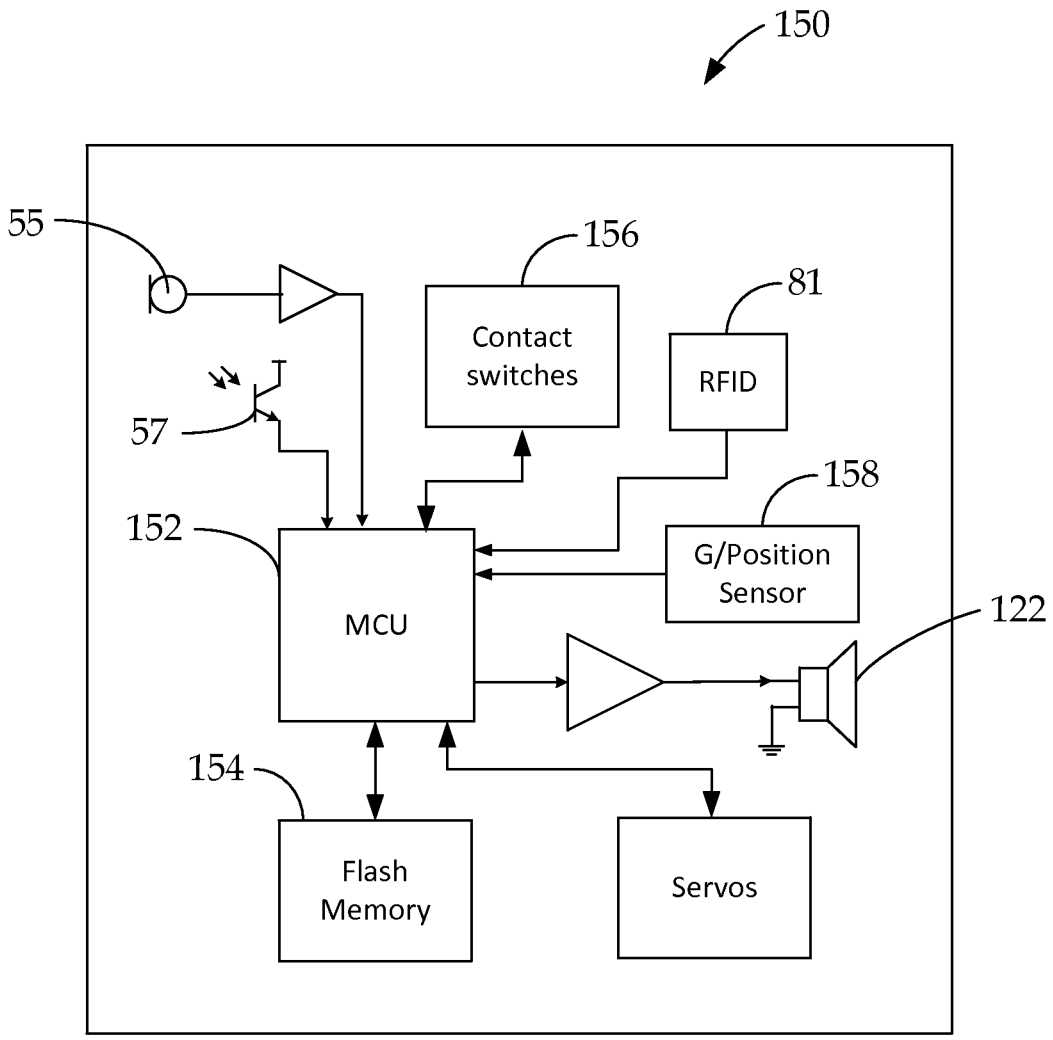
FIG. 11 is a functional block diagram of the control circuit of the interactive robotic apparatus of the present invention.

Referring to FIG. 11, a control circuit is generally indicated by reference numeral 150. The control circuit includes a microprocessor control unit ("MCU") 152 and an internal memory 154. The MCU 152 receives power from the battery pack 120 and inputs from the microphone 55, and photo transistor 57, as well as one or more capacitive touch sensors 156 mounted to the external surfaces of the interactive robotic apparatus 20 below the covering 30. The MCU 152 also receives input from the RFID coil 81, as well as a G/position sensor 158.

The MCU 152 controls the rotation of the eyes 42 and 44 and blinking of the eyelids 54 and 56. In response to sounds received via microphone 55 and inputs from touch sensors 156, the MCU 152 may actuate the nose actuator 92 to move the nose 38 up and down, and actuate the ears actuator 88 to move the ears 84 and 86. The MCU 152 also controls rotation of the head assembly 22 and associated servo actuators. The MCU 152 sends a signal to the heartbeat actuator 126 and breathing actuator 112 to simulate a heartbeat and breathing, respectively.

Operationally, the MCU 152 produces various moods such as happy, unhappy, and sleepy, for example. A happy expression may include moving the head 22 and nose 38 up, while blinking the eyes 42 and 44 by actuating the eyelids 54 and 56, and outputting a happy sound via speaker 122. When unhappy, the MCU 152 may move the head 22 down, and outputting an unhappy sound, for example. A sleepy expression may include moving the head 22 down, closing the eyes 42 and 44 by actuating the eyelids 54 and 56, and outputting a snoring sound via the speaker 122.

When touched or petted, detected by the MCU 152 via input from the touch sensors 156, the MCU 152 may output a happy expression. If a food accessory such as a dog bone or treat containing an RFID is placed near the mouth 40, the RFID coil 81 will sense the presence of the food accessory, which will be detected by the MCU 152. The MCU 152 may generate a happy response such as moving the head 22 and nose 38 up, while blinking the eyes 42 and 44 by actuating the eyelids 54 and 56, and outputting a happy sound via speaker 122, for example. Other RFID accessories may be used to elicit other responses. If the g/position sensor 158 or contact switches 156 detect a sudden movement such as a strike or drop, the MCU 152 may move the head 22 down and output an unhappy sound via speaker 122. If the g/position sensor 158 detects that the apparatus 20 is being held upside-down, the MCU 152 may move the head 22 side to side quickly and output an angry or unhappy sound via speaker 122, for example.

It is to be understood that while certain forms of this invention have been illustrated and described, it is not limited thereto, except in so far as such limitations are included in the following claims and allowable equivalents thereof.

Having thus described the invention, what is claimed as new and desired to be secured by Letters Patent is as follows:

1. An interactive robotic apparatus comprising:

a head assembly having eyes, eyelids, a nose, a mouth, an eye actuator coupled to said eyes to rotate said eyes from side to side, eye lid actuators to pivot said eyelids between open and closed positions, and a mouth actuator coupled to said mouth, left and right ears each coupled to an ear actuator to move said ears up and down or back and forth, said ear actuators mounted to said head assembly, a photo transistor mounted to said nose, an RFID sensor mounted to said head assembly near said mouth, a body assembly having a neck, two or more legs, a neck actuator coupled to said head assembly to rotate said head assembly side to side and up and down, a breast plate coupled to a belly actuator to move said breast plate in and out to simulate a breathing motion, a speaker mounted to said body assembly, a microphone mounted to said head assembly, a heartbeat simulator mounted within said body assembly to simulate a heartbeat, a plurality of touch sensors mounted on said head assembly and said body assembly, a microprocessor control unit and power supply mounted in said body assembly and coupled to said eye actuator, eyelid actuators, mouth actuator, ear actuators, photo transistor, RFID sensor, neck actuator, belly actuator, speaker, microphone, heartbeat simulator and plurality of touch sensors, said microprocessor responsive to input received from said photo transistor, RFID, microphone and/or touch sensors to selectively actuate said eye actuator, eyelid actuators, mouth actuator, ear actuators, neck actuator, heartbeat actuator, belly actuator and/or speaker.

2. The interactive robotic apparatus of claim 1 further comprising a nose actuator coupled to said nose and responsive to commands received from said microprocessor control unit to move said nose.

3. The interactive robotic apparatus of claim 1 further comprising a g/position sensor mounted in said body assembly and coupled to said microprocessor control unit, wherein said microprocessor control unit is responsive to input from said g/position sensor to selectively actuate said eye actuator, eyelid actuators, mouth actuator, ear actuators, neck actuator, heartbeat simulator, belly actuator and/or speaker.

4. The interactive robotic apparatus of claim 1 further comprising a material covering said head assembly, ears and body assembly.

* * * * *